US007330803B2

(12) United States Patent
Pattee et al.

(10) Patent No.: US 7,330,803 B2
(45) Date of Patent: Feb. 12, 2008

(54) HIGH RESOLUTION TIME INTERVAL MEASUREMENT APPARATUS AND METHOD

(75) Inventors: Jack Pattee, Davisberg, MI (US); Mikhail S. Zhukov, Rochester Hills, MI (US)

(73) Assignee: Ametek, Inc., Paoli, PA (US)

( * ) Notice: Subject to any disclaimer, the term of this patent is extended or adjusted under 35 U.S.C. 154(b) by 0 days.

(21) Appl. No.: 11/158,442

(22) Filed: Jun. 22, 2005

(65) Prior Publication Data

US 2007/0005288 A1 Jan. 4, 2007

(51) Int. Cl.

| | |
|---|---|
| ***G04F 10/00*** | (2006.01) |
| *G04F 10/04* | (2006.01) |
| *G04F 10/10* | (2006.01) |
| *G04F 10/06* | (2006.01) |

(52) U.S. Cl. ..... 702/176; 368/89; 368/118; 377/20; 702/79

(58) Field of Classification Search ..... 368/89, 368/118, 120; 377/20; 702/79, 176
See application file for complete search history.

(56) References Cited

U.S. PATENT DOCUMENTS

| | | | | |
|---|---|---|---|---|
| 2,738,461 | A * | 3/1956 | Burbeck et al. | 368/119 |
| 2,831,162 | A * | 4/1958 | Gross | 368/118 |
| 3,541,448 | A * | 11/1970 | Nutt | 368/118 |
| 3,553,582 | A * | 1/1971 | Gouillou | 368/118 |
| 3,868,845 | A * | 3/1975 | Shimizu | 73/1.48 |
| 4,303,983 | A * | 12/1981 | Chaborski | 702/176 |
| 4,468,746 | A * | 8/1984 | Davis | 702/178 |
| 5,001,683 | A * | 3/1991 | Fukumoto et al. | 368/113 |
| 5,134,377 | A | 7/1992 | Reddy, III et al. | |
| 5,376,888 | A | 12/1994 | Hook | |
| 5,382,910 | A | 1/1995 | Walsh | |
| 5,440,528 | A | 8/1995 | Walsh | |
| 5,609,059 | A | 3/1997 | McEwan | |
| 5,656,774 | A | 8/1997 | Nelson et al. | |
| 5,726,578 | A | 3/1998 | Hook | |
| 6,100,700 | A | 8/2000 | Yankielum et al. | |
| 6,104,200 | A | 8/2000 | Hook | |
| 6,404,288 | B1 | 6/2002 | Bletz et al. | |
| 6,477,474 | B2 | 11/2002 | Diede | |
| 6,531,977 | B2 | 3/2003 | McEwan | |
| 6,640,629 | B2 | 11/2003 | Carsella et al. | |

(Continued)

FOREIGN PATENT DOCUMENTS

EP 0 142 644 A1 * 5/1985

(Continued)

OTHER PUBLICATIONS

Design and Characterization of CMOS High-Resolution Time-to-Digital Converters, Manuel José obs Reis Gaspar Seabra Mota, Oct. 2000, Technical University of Lisbon, thesis, especially Chapter Four.

*Primary Examiner*—Edward R Cosimano
(74) *Attorney, Agent, or Firm*—Young Basile

(57) ABSTRACT

A time interval measurement apparatus and method counts the total number of full clock time periods between two measurement signals. Clock fractional time periods are generated between each of the two measurement signals and the next leading edge of a full clock time period. The total number of full clock time periods and the clock fractional time periods are converted to a time equivalent measurement and combined to generate the total time interval between the two measurement signals.

14 Claims, 2 Drawing Sheets

U.S. PATENT DOCUMENTS

| | | | |
|---|---|---|---|
| 6,653,844 | B2 | 11/2003 | Wyar |
| 6,690,320 | B2 | 2/2004 | Benway et al. |
| 2002/0126273 | A1 | 9/2002 | Carsella et al. |
| 2003/0147506 | A1 | 8/2003 | Kamali et al. |
| 2003/0163272 | A1 | 8/2003 | Karburlasos et al. |
| 2004/0027137 | A1 | 2/2004 | Sherrard |
| 2004/0036482 | A1 | 2/2004 | Sherrard |
| 2004/0066324 | A1 | 4/2004 | Haynes |
| 2007/0005288 | A1* | 1/2007 | Pattee et al. ..... 702/125 |

FOREIGN PATENT DOCUMENTS

| | | | |
|---|---|---|---|
| EP | 0 650 256 | A2 * | 4/1995 |
| JP | 56-69581 | A * | 6/1981 |
| JP | 8-146160 | A * | 6/1996 |

* cited by examiner

Tactual = T1 + [(N - 1) * Tclock)] + (Tclock - T2)
Tactual = T1 + (N * Tclock) - T2

HIGH RESOLUTION TIME INTERVAL MEASUREMENT APPARATUS AND METHOD

BACKGROUND

The present invention relates, in general, to time interval measurement apparatus and methods.

Precise digital time interval measurement is an important part of the operation for many electronic sensor or conversion devices. The traditional method for conversion of a time to a numeric value (i.e. digital) is based on counting pulses from a constant frequency clock source.

If time interval to be measured is from time $t_1$ to time $t_2$, see FIG. 1, then the total duration $t=t_2-t_1$. The clock starts counting at time $T_1$ and stops at the time $T_2$. The interval time T is calculated by multiplying the time of the clock period $T_{clock}$ by the number of counts N:

$$T=T_{clock}\cdot N$$

There is a time measurement error associated with this method that is due to the occurrence of the starting and stopping signals for the interval relative to the clock edges used for counting. This includes $(T_1-t_1)$ and $(T_2-t_2)$ and these differences can add up to be $T_{clock}$. This error can be reduced by decreasing $T_{clock}$ (i.e., increasing the clock frequency: $F_{clock}=1/T_{clock}$). However, as the frequency increases, so does the complexity, power consumption and cost of the measurement circuit.

In sensors that determine the value of the measured variable by means of time interval measurement, very precise time measurement is a critical aspect of the precision of the sensor. In the past, high frequency counters (greater than 100 MHz) and Application Specific Integrated Circuits (ASICs) were used to achieve these very fine measurements of time. These circuits have inherent drawbacks which include high cost, high power consumption (i.e. not conducive to battery powered devices), and are prone to EMC noise emissions.

It would be desirable to provide a time measurement apparatus and method which addresses the deficiencies of prior time interval measurement apparatus and methods. It would also be desirable to provide a time interval measurement apparatus and method which can very precisely measure time intervals at high frequency rates.

It would also be desirable to provide a time interval measurement apparatus and method which has minimal measurement error without requiring increased clock frequencies. It would also be desirable to provide a time interval measurement apparatus and method which is not only capable of measuring time periods with extremely high resolution, but provides the measurement over a very long time period without jeopardizing the time resolution. It would also be desirable to provide a time interval measurement apparatus and method which has these features without requiring costly ASICs or high frequency oscillator and counter circuitry.

SUMMARY

An apparatus and method for measuring time intervals between an initial first measurement signal and one or more subsequent measurement signals.

In one aspect, a time interval measurement apparatus includes means for counting the total number of full clock periods, each having a set clock period, between an initial first measurement signal and each subsequent measurement signal, means for generating clock fractional time periods starting from the start of each of the first and each subsequent measurement signal and the start of the next respective clock period, and means for combining the generated clock fractional time periods and the total number of clock periods to generate the total time interval between the first and each subsequent measurement signal.

In another aspect, a method of measuring a time interval between an initial first measurement signal and one or more subsequent measurement signals comprises the steps of:

generating successive clock pulses having identical clock time periods between successive ones of leading and trailing clock pulse edges;

determining a total number of full clock time periods between the first and each subsequent measurement signal;

generating clock fractional periods between each of the first and subsequent measurement signals and the leading edge of the next clock time period; and combining the total number of full clock time periods and all of the clock fractional periods between the first and each subsequent measurement signals to determine the total time interval between the first and each subsequent measurement signals.

In another aspect, a method of measuring time intervals between an initial first and one or more subsequent measurement signals comprises the steps of:

counting the total number of full clock time periods, each having a set clock period, between a first measurement signal and a subsequent measurement signal;

generating clock fractional periods starting from the start of each of the first and each subsequent measurement signal and the start of the next respective clock period; and combining the generated clock fractional periods and the total number of clock time periods to generate the total time interval between the first and subsequent measurement signals.

The time interval measurement apparatus and method of the present invention addresses many of the deficiencies of previously devised timing apparatus and time measurement methods in that the present apparatus and method precisely measure time intervals at high frequency rates with minimal measurement error and without requiring increased clock frequencies for high resolution. The present apparatus and method also provide high timing measurement resolution over very long time periods. The present apparatus can be constructed with low cost components since the previously required costly ASICs or high frequency oscillator and counter circuitry are not required.

BRIEF DESCRIPTION OF THE DRAWING

The various features, advantages and other uses of the present invention will become more apparent by referring to the following detailed description and drawing in which.

DETAILED DESCRIPTION

The present apparatus and method measures long time periods with high resolution by measuring the "long" portion of the period with a low frequency counter while the "high resolution" is achieved by precisely measuring the time difference between the starting and stopping edges of the actual signal period and the clocking edges of the clock used to measure the "long" time period. The entire measurement process is accomplished by using relatively low cost counters, linear ramp generators and analog to digital converters (ADCs), or implemented mostly by a microcontroller.

The long period time measurement is accomplished by simply activating a counter when the timing period is active. At the end of the timing period, the accumulated value from the counter is acquired.

The high resolution measurement technique is achieved by converting the time based measurement to an analog based measurement. This is done by using a linear ramp generator circuit gated by a fractional pulse generator signal. The peak voltage of the ramp should be set such that it does not exceed the ADC's input capabilities and the maximum time portion of ramp should be set to the longest period of measurement needed at the high resolution (i.e., the low frequency clock period). The linear ramp generator circuit has the capability to temporarily hold or store the output signal. This allows ADC time to convert the analog signals to digital values.

The analog ramp signal is fed into an ADC and is quantized at the resolution of the ADC. For example, if a 10 bit ADC is used, its resolution would be 1 part in 1024 ($2^{10}$). If the counter clock frequency was 1 Mhz and the ramp was set to span this period (i.e. 1 microsecond), then the resolution of this time measurement would be 1 microsecond divided by 1024 or 0.97 nanoseconds.

If the time interval measurement apparatus and method is implemented in the circuitry, the circuitry could have the ability to calibrate itself simply by measuring the period of the whole clock cycle, instead of letting the ramp signal start based its normal starting signal. This "calibration" cycle could be done periodically to compensate for various sources of electronic error (i.e., temperature drift).

Figure 1:
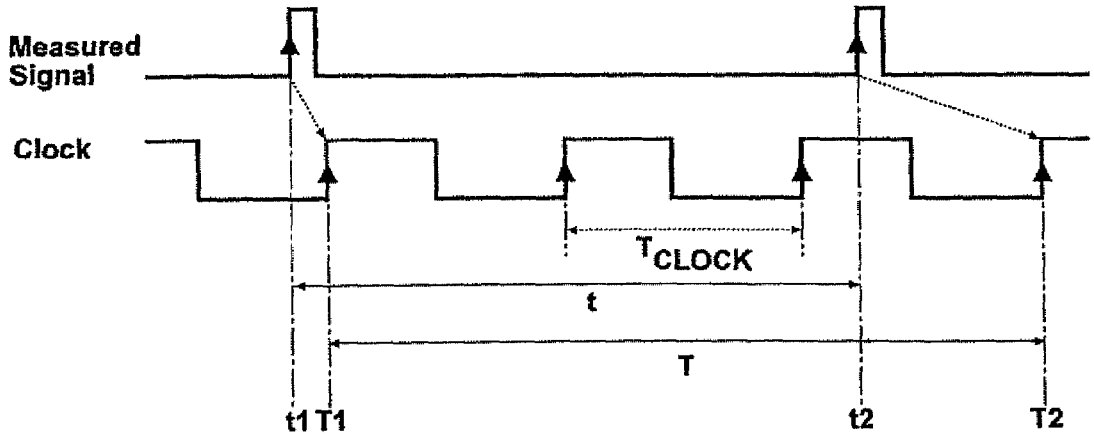
FIG - 1 Prior Art
FIG. 1 is a prior art timing diagram showing the counting of clock pulses to obtain a time interval measurement.
Figure 2:
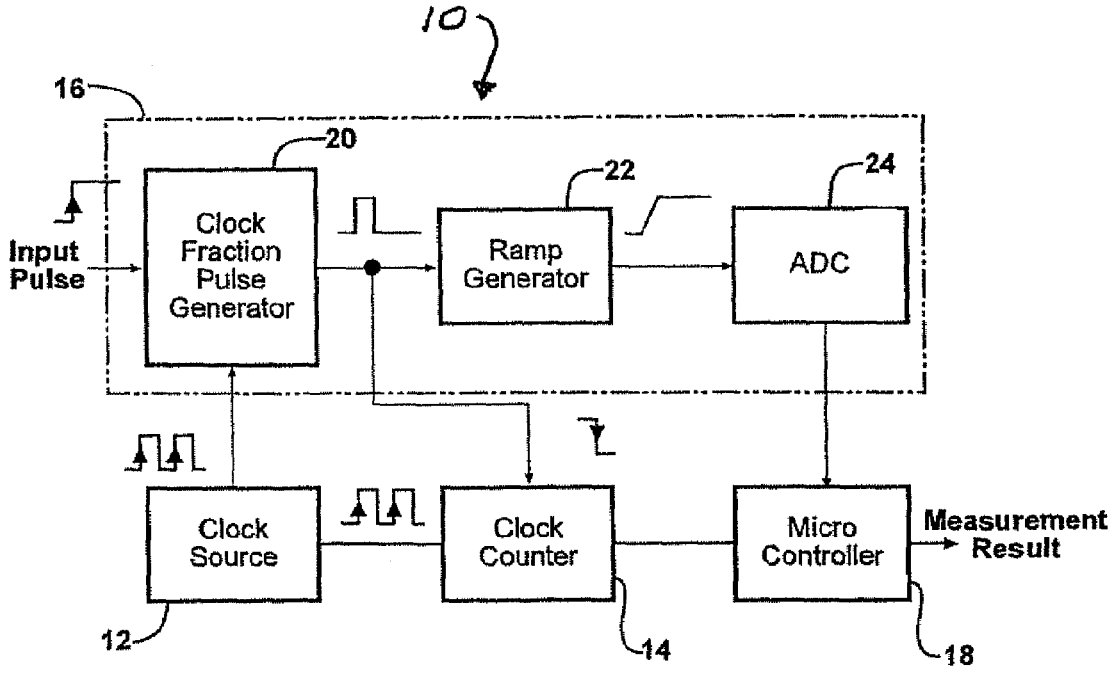
FIG. 2 is a block diagram of a time interval measurement apparatus.

A block diagram of one aspect of a time interval measurement circuit 10 is shown in FIG. 2. The circuit 10 includes a clock source 12, a clock counter 14, a fractional clock measurement circuit 16, and a microcontroller 18.

The clock source 12 supplies stable and accurate low frequency clock pulses to the clock counter 14 and the clock fraction measurement circuit 16. The stability of the clock source 12 should be better than the highest accuracy the circuit 10 is intended to provide, however, the symmetry of the clock cycle does not need to be exactly 50% because the counter 14 is incremented always using the same clock edge (i.e., the rising edge).

The clock counter 14 measures coarse time values. As indicated in the timing diagram of FIG. 3, incrementing the count of the clock pulses occurs on the rising edge of the clock pulses. The falling edge of clock fraction pulse signals is used to capture the clock counter 14 value.

The microcontroller 18 collects all of the data and computes the measured high resolution time period utilizing formulas described hereafter.

The fractional clock measurement circuit 16 consists of three elements as shown in FIG. 2, namely, a clock fraction pulse generator 20, an analog ramp generator 22, and an analog-to-digital converter (ADC) 24.

Figure 3:
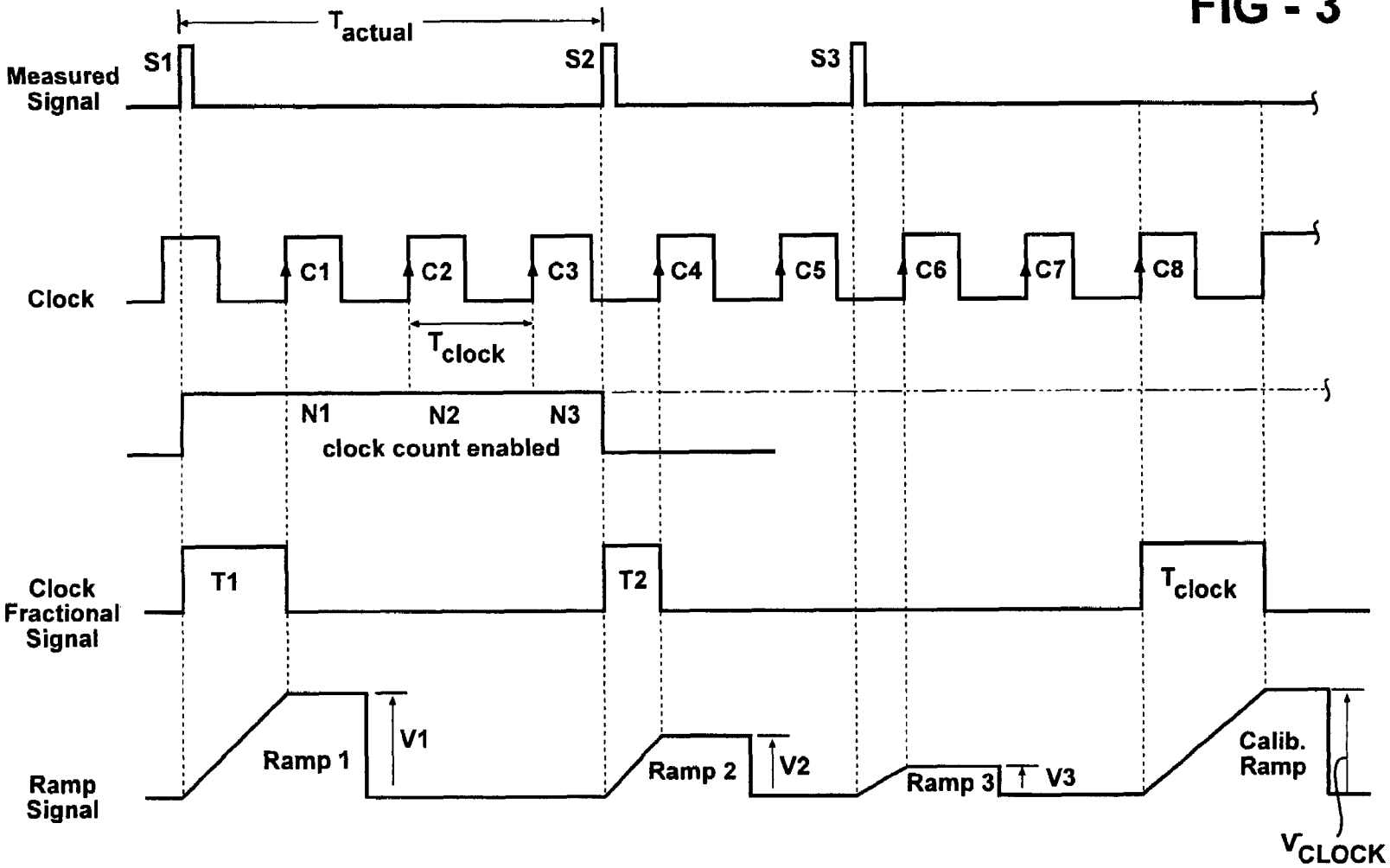
FIG. 3 is a timing diagram showing the use of the ramp signal to generate clock fractional period time measurements.

The clock fraction pulse generator 20 combines the clock signal and the measurement signal or input pulse to create a pulse that has a width equal to the time difference between the edges of the signal being measured and the edge of the clock pulse, see FIG. 3. In other words, it generates $T_{clock}$, $T_1$ and $T_2$ width pulses. The $T_{clock}$ period is used for calibration and will be explained hereafter.

The ramp generator 22 converts the width of these pulses to a DC voltage. $T_{clock}$, $T_1$ and $T_2$ time values are converted to $V_{clock}$, $V_1$, and $V_2$ voltages, respectively. For a linear ramp generator 22 with a slope S, the relationship between the time periods and the voltages are described as follows:

$$V_{clock}=S\cdot T_{clock}$$

$$V_1=S\cdot T_1$$

$$V_2=S\cdot T_2$$

In order to do multiple conversions using the same linear ramp circuit, the ramp generator 22 should have the capability of being reset to zero volts rapidly so that it can prepare for the next fractional clock period measurement.

The ADC 24 measures the ramp generator 22 voltages and converts the voltage to a numeric value (digital). The time interval measurement apparatus has the capability of calibrating itself including calibration of the ADC 24 function, the ramp generator, the effect of temperature drift or any component tolerance, etc. If the clock period is known ($T_{clock}$) and a crystal controlled clock source 12 is being used (very stable with time and temperature) then the clock period can be measured with the linear ramp ($V_{clock}$) and a mathematical compensation can be performed for a change in the ramp's slope due to component variation and temperature drift. This relationship can be described by the following equations:

$$S=V_{clock}/T_{clock}$$

$$T_1=T_{clock}\cdot(V_1/V_{clock})$$

$$T_2=T_{clock}\cdot(V_2/V_{clock})$$

To effectively use the calibration process and to reduce the ramp slope drift errors, the measurement of the $V_{clock}$ voltage should be taken close in time to the measurement of $V_1$ and $V_2$.

$T_{clock}$, as described above, may be employed at any time after the ramp signal value has been convened to a digital value and used to calculate one fractional clock time period, the entire apparatus may be recalibrated or the recalibration may be implemented at the end of the last measurement signal, such as measurement signal S3 in FIG. 3 by using clock leading edges C6, C7 and C8 and recalibrating $T_{clock}$ to a calibration ramp signal "Calib Ramp" in the same manner as described hereafter.

A calibration ramp signal is generated to generate $V_{clock}$.

For an explanation of the conversion process, simple "round" numbers will be used for clarification purposes. Referencing FIG. 3, the clock period is 10 counts and the resolution of the ADC 24 is 10 counts. In a real world example, a low frequency clock of 1 Mhz and an ADC resolution of 10 bits with a maximum input voltage of 5 volts would be typical.

The low frequency clock source 12 is "free running" on a continuous basis.

The first or initial signal of the period to be measured is received (S1), signifying the beginning of the measurement period. At this point two events occur. The counter 14 is enabled, allowing the low frequency counter 14 to count, and also, the linear ramp circuit 22 (Ramp1) is released, allowing the voltage to begin its ramp.

As time transpires and the next rising edge of the clock is received (C1), the ramp generator circuit 22 is disabled and its amplitude is maintained at the level the ramp reached within that time. Also, the counter 14 increments its count value. The ADC 24 is initiated to measure Ramp1 and to acquire the voltage level of the ramp ($V_1$).

As more time elapses, the low frequency counter 14 continues to count on every positive clock edge, two more times in this example, C2 and C3 through clock period N1, N2 and N3.

A second or subsequent signal of the period to be measured is then received (S2), signifying the end of one measurement period. At this point two further events occur. In one aspect, the gate of the counter 14 is disabled, preventing the low frequency counter 14 from further counting and, also, the linear ramp circuit 22 (Ramp2) is released, allowing the voltage to begin its ramp. In another aspect, the count from the counter 14 is stored at S2, while the counter 14 continues to count.

As the next rising edge of the clock is received (C4), the ramp generator circuit 22 is disabled and its amplitude is maintained at the level the ramp reached within that time. The ADC 24 is initiated to measure Ramp2 to acquire the voltage level of the ramp ($V_2$).

At this point, all of the raw measurements have been taken, i.e., $V_1$, the low frequency count, and $V_2$. Calculations are performed on these values to derive the actual time period.

The calculation for the actual time period measurement performed by the microcontroller 18 is as follows:

$$T_{actual}=T1+(N*T_{clock})-T2$$

where: $T_{actual}$ is the actual time of the period being measured,

T1 is the difference between the initial start pulse and the first clock edge, (fractional clock time period)

N is the number of clock cycles accumulated over the measured period, $T_{clock}$ is the time of one clock period, and T2 is the difference between the last clock edge and final stop pulse (fractional clock time period)

For the example, $T_{clock}=10$ $V_1=8$ i.e.: $T1=0.8\times10$ $V_2=4$ i.e.: $T2=0.4\times10$ $N=3$ $T_{actual}=(N*T_{clock})+T1-T2$ $T_{actual}=(3*10)+8-4$ $T_{actual}=34$ time units As can be seen by this equation, $T_{actual}$, or the time interval between the first initial measurement signal and the second or other subsequent measurement signal, is generated by combining the clock fractional time periods and the total number of full clock time periods between the two measurement signals.

It will also be understood that instead of the separate clock source 12, clock counter 14, and ADC 24 shown in FIG. 2, the functions of the clock source, clock counter and analog-to-digital converter (ADC) may be incorporated into the microcontroller 18. This further simplifies the cost of the present time interval measurement apparatus due to the reduction in the number of separate hardware components.

It will be understood that the above-described time interval measurement apparatus and method for measuring the time interval between a first or initial measurement signal and a subsequent or second measurement signal can, using the same circuit shown in FIG. 2, be used for multiple sets of first and second measurement signals. It is also possible, using the same circuit shown in FIG. 2, to utilize the first, initial measurement signal S1 and multiple subsequent measurement signals, such as S2, S3, etc. The method for developing the time interval between the first initial measurement signal and each of the subsequent measurement signals S3, etc., is the same as that described above for measuring the time interval between the first measurement signal S1 and the second subsequent measurement signal S2.

It will also be understood that when multiple subsequent signals are to be measured for individual time intervals with respect to the first initial measurement signal, the counter, whether implemented as a hardwired component 14 as shown in FIG. 2 or as part of the microcontroller 18, remains activated in a counting state throughout the total measurement interval. The total number of full clock time periods from the initial measurement signal S1 and each of the subsequent measurement signals S2, S3, etc., are individually held in a stored state for calculation of the respective time interval while the counter function continues as shown by the dotted line in FIG. 3 depicting the clock count enabled state through clock periods C4 and C5 and V3 for Ramp 3 for signal S3.

The present time interval measurement apparatus and method may be used in many different technologies and applications where any measurable quantity can be sensed as a time measurement. Such applications include magnetostriction, ultrasonic, radar, etc. In the case of magnetostriction, one example of a time propagation constant for a wave transmitted along a wire is 9.123 microseconds per inch. If the time interval between two signals generated during the transmission of the signal along the wire is determined by the method described above, the length or distance between the two measurement locations can be determined. The measurement signals may be generated by two magnets spaced along the magnetostrictive wire. Alternately, the two measurement signals may include the initial transit pulse on the magnetostrictive wire and a second measurement signal provided by a magnet associated with the wire.

There has been disclosed a novel time interval measurement apparatus and method which overcomes the deficiencies found in previously devised high speed or high resolution time interval measurement apparatus. The present time interval measurement apparatus and method very precisely measures time intervals, without requiring high frequency counters or ASICs which have a high cost, high power consumption which is not conducive to battery powered devices and are prone to EMC noise emissions.

What is claimed is:

1. A time interval measurement apparatus comprising:

a single signal channel carrying an initial signal and a plurality of time spaced subsequent signals;

means for generating a continuous stream of full clock time periods, each having a set clock time;

a single counter, the counter counting a total number of full clock time periods between the initial signal and each one of the subsequent signals;

single means for generating a first clock fractional time period starting from the initial signal and the start of the next clock time period, and a second clock fractional period between each one of the subsequent signals, and the start of the next respective clock time period;

single means for combining the first and second clock fractional periods and the total number of clock time periods to generate the total time intervals between the initial signal and each one of the subsequent signals; and the single counter, the single means for generating clock fractional time periods, and the single means for combining defining a single measurement channel for measuring the time intervals between the initial signal and each of the plurality of subsequent signals.

2. The apparatus of claim 1 wherein the combining means comprises:

means for adding the initial fractional time period and the total number of time period and subtracting the subsequent fractional time period.

3. The apparatus of claim 1 wherein:

the generating means generating a subsequent clock fractional time period at the start of each subsequent signal; and the combining means combining the clock fractional time period for the initial signal and the clock fractional time period for any subsequent signal and the total number of full clock time periods between the initial signal and the any subsequent signal.

4. The apparatus of claim 3 wherein the combining means comprises:

means for adding the initial fractional time period and the total number of time period and subtracting the subsequent fractional time period.

5. The apparatus of claim 1 wherein the means for generating clock fractional time periods further comprises:

ramp generator means for generating a ramp signal at the start of each clock fractional time period;

means for converting an amplitude of the ramp signal for each clock fractional time period at the start of the next clock time period to a digital value; and means, responsive to the converting means, for calculating the clock fractional time period.

6. The apparatus of claim 5 wherein the converting means comprises:

an analog to digital converter.

7. The apparatus of claim 5 wherein the calculating means comprises:

a processor operating a control program.

8. A method for measuring a time interval between an initial signal and each one of a plurality of time spaced subsequent signals carried on a single signal channel comprising the steps of:

generating a continuous stream of successive clock pulses having identical clock time periods, each having leading clock pulse edge;

determining a total number of full clock time periods between the initial signal and each one of the plurality of subsequent signals in a single counter;

generating clock fractional time periods between each of the initial signal and each one of the subsequent signals, and the leading edge of the next respective clock time period; and combining the total number of full clock time periods and all of the clock fractional time periods between the initial signal and each one of the subsequent signals to determine the total time intervals between the initial signal and each one of the subsequent signals.

9. The method of claim 8 wherein the step of combining comprises the steps of:

adding the initial fractional time period and the total number of clock periods and subtracting the subsequent fractional time period.

10. The method of claim 8 further comprising the steps of:

generating a subsequent clock fractional time period at the start of each subsequent signal; and combining the clock fractional time period for the initial signal and the clock fractional time period for any subsequent signal and the total number of full clock time periods between the initial signal and the any subsequent signal.

11. The apparatus of claim 10 wherein the combining means comprises:

means for adding the initial fractional time period and the total number of time period and subtracting the subsequent fractional time period.

12. The method of claim 8 wherein the step of generating the clock fractional time periods further comprises the steps of:

generating a ramp voltage signal at the start of each clock fractional time period;

converting the amplitude of the ramp signal for each clock fractional time period up to the start of the next clock time period to a digital value; and calculating the time interval from the digital value.

13. The method of claim 12 wherein the step of converting further comprises the step of:

converting the analog voltage ramp signal to a digital value.

14. The method of claim 12 wherein the step of calculating further comprises the step of:

executing a control program by a processor.

* * * * *